US009273868B2

(12) United States Patent
Melton

(10) Patent No.: US 9,273,868 B2
(45) Date of Patent: Mar. 1, 2016

(54) SYSTEM FOR SUPPORTING BUNDLED TUBE SEGMENTS WITHIN A COMBUSTOR

(71) Applicant: General Electric Company, Schenectady, NY (US)

(72) Inventor: Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 304 days.

(21) Appl. No.: 13/959,830

(22) Filed: Aug. 6, 2013

(65) Prior Publication Data

US 2015/0040579 A1 Feb. 12, 2015

(51) Int. Cl.

| | |
|---|---|
| ***F23R 3/60*** | (2006.01) |
| ***F23R 3/32*** | (2006.01) |
| ***F23R 3/28*** | (2006.01) |
| ***F23R 3/10*** | (2006.01) |

(52) U.S. Cl.

CPC .. *F23R 3/283* (2013.01); *F23R 3/10* (2013.01)

(58) Field of Classification Search

CPC ..... F23R 3/045; F23R 3/32; F23R 3/60; F23R 3/283; F23R 3/286

See application file for complete search history.

(56) References Cited

U.S. PATENT DOCUMENTS

| | | | | | |
|---|---|---|---|---|---|
| 2,676,460 | A | * | 4/1954 | Brown | 60/742 |
| 2,720,080 | A | * | 10/1955 | Oulianoff et al. | 60/804 |
| 3,771,500 | A | | 11/1973 | Shakiba | |
| 4,104,873 | A | | 8/1978 | Coffinberry | |
| 4,292,801 | A | * | 10/1981 | Wilkes et al. | 60/776 |
| 4,408,461 | A | * | 10/1983 | Bruhwiler et al. | 60/737 |
| 4,412,414 | A | | 11/1983 | Novick et al. | |
| 5,104,310 | A | | 4/1992 | Saltin | |
| 5,199,265 | A | * | 4/1993 | Borkowicz | 60/737 |
| 5,205,120 | A | | 4/1993 | Oblander et al. | |
| 5,213,494 | A | | 5/1993 | Jeppesen | |
| 5,274,991 | A | * | 1/1994 | Fitts | 60/800 |
| 5,341,645 | A | | 8/1994 | Ansart et al. | |
| 5,439,532 | A | | 8/1995 | Fraas | |
| 5,592,819 | A | | 1/1997 | Ansart et al. | |
| 5,707,591 | A | | 1/1998 | Semedard et al. | |
| 6,098,407 | A | | 8/2000 | Korzendorfer et al. | |
| 6,123,542 | A | | 9/2000 | Joshi et al. | |
| 6,394,791 | B2 | | 5/2002 | Smith et al. | |
| 6,438,961 | B2 | | 8/2002 | Tuthill et al. | |
| 6,672,073 | B2 | * | 1/2004 | Wiebe | F23R 3/283 60/747 |
| 6,796,790 | B2 | | 9/2004 | Venizelos et al. | |
| 6,983,600 | B1 | | 1/2006 | Dinu et al. | |
| 7,003,958 | B2 | | 2/2006 | Dinu et al. | |
| 7,007,478 | B2 | | 3/2006 | Dinu | |
| 7,631,499 | B2 | | 12/2009 | Bland | |
| 7,721,546 | B2 | * | 5/2010 | Fish et al. | F23R 3/283 60/739 |

(Continued)

*Primary Examiner* — William H Rodriguez
*Assistant Examiner* — Eric Linderman
(74) *Attorney, Agent, or Firm* — Dority & Manning, PA

(57) ABSTRACT

A system for supporting bundled tube segments within a combustor includes an annular sleeve that extends circumferentially and axially within the combustor, a support lug that extends radially inward from the annular sleeve and an annular support frame that is disposed within the annular sleeve. The annular support frame includes an inner ring portion, an outer ring portion and a plurality of spokes that extend radially between the inner and outer ring portions. The inner ring portion, the outer ring portion and the plurality of spokes define an annular array of openings for receiving a respective bundled tube segment. The inner ring portion is connected to each bundled tube segment and the outer ring portion is coupled to the support lug.

16 Claims, 7 Drawing Sheets

(56) References Cited

U.S. PATENT DOCUMENTS

| | | | | |
|---|---|---|---|---|
| 7,752,850 | B2 | 7/2010 | Laster et al. | |
| 8,087,228 | B2 * | 1/2012 | McMahan et al. | 60/39.37 |
| 8,276,387 | B2 * | 10/2012 | Prociw et al. | F02C 7/222 60/734 |
| 8,443,611 | B2 * | 5/2013 | Belsom et al. | 60/772 |
| 8,733,108 | B2 * | 5/2014 | Kim et al. | F23C 5/08 60/725 |
| 2003/0159446 | A1 * | 8/2003 | Parker et al. | 60/772 |
| 2004/0216463 | A1 | 11/2004 | Harris | |
| 2008/0016876 | A1 | 1/2008 | Colibaba-Evulet et al. | |
| 2008/0092545 | A1 * | 4/2008 | Fish et al. | F02C 7/222 60/739 |
| 2008/0304958 | A1 | 12/2008 | Norris et al. | |
| 2009/0223227 | A1 * | 9/2009 | Lipinski et al. | 60/746 |
| 2009/0243230 | A1 * | 10/2009 | Myers et al. | 277/618 |
| 2009/0293489 | A1 | 12/2009 | Tuthill et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacy et al. | |
| 2010/0186413 | A1 | 7/2010 | Lacy et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2010/0293955 | A1 * | 11/2010 | Berry et al. | F23R 3/286 60/742 |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2011/0100016 | A1 * | 5/2011 | Cihlar et al. | 60/772 |
| 2011/0107764 | A1 * | 5/2011 | Bailey et al. | 60/737 |
| 2011/0113783 | A1 | 5/2011 | Boardman et al. | |
| 2011/0179795 | A1 * | 7/2011 | Johnson et al. | 60/725 |
| 2012/0045725 | A1 * | 2/2012 | Takiguchi et al. | F23R 3/14 431/60 |
| 2012/0291451 | A1 | 11/2012 | Moehrle et al. | |
| 2013/0084534 | A1 * | 4/2013 | Melton et al. | 431/2 |
| 2013/0263604 | A1 * | 10/2013 | Stoia et al. | 60/746 |
| 2014/0190169 | A1 * | 7/2014 | Melton et al. | 60/738 |
| 2015/0040579 | A1 * | 2/2015 | Melton | 60/796 |

* cited by examiner

SYSTEM FOR SUPPORTING BUNDLED TUBE SEGMENTS WITHIN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor such as may be incorporated into a gas turbine or other turbomachine. Specifically, the invention relates to a combustor having a system for supporting a plurality of bundled tube segments within the combustor.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section progressively increases the pressure of the working fluid and supplies a compressed working fluid to the combustion section. A fuel is mixed with the compressed working fluid within the combustion section and the mixture is burned in a combustion chamber defined within the combustion section to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include one or more combustors annularly arranged between the compressor section and the turbine section. In a particular combustor design, each combustor includes an end cover that is connected to an outer casing so as to form a high pressure plenum around the combustor. Each combustor also includes a plurality of bundled tube segments or sectors disposed downstream from the end cover. The plurality of bundled tube segments are generally arranged in an annular array about an axial centerline of the end cover and/or about an axially extending center fuel nozzle. Each bundled tube segment is fluidly connected to the end cover via a fluid conduit that extends axially downstream from the end cover.

Each bundled tube segment generally includes a plurality of parallel tubes arranged radially and circumferentially across the bundled tube segment. The parallel tubes extend generally axially through a fuel plenum defined within the bundled tube segment. The tubes provide for fluid communication through the fuel plenum and into the combustion chamber. One end of the fluid conduit is rigidly bolted to the end cover and a second end is fixedly or rigidly connected to the bundled tube segment, thereby creating an end loaded cantilever. As a result, the fluid conduit generally carries the structural load created by the cantilevered bundled tube segment at the connection joint defined at the end cover.

As the combustor cycles through various operating modes, the cantilevered bundled tube segments vibrate at various frequencies which may result in large deflections of the fluid conduit, thereby causing undesirable bending stresses at the end cover and fluid conduit connection joint. In addition, the vibrations may result in the adjacent bundled tube segments clashing together, thereby potentially resulting in durability issues. Therefore, an improved system for mounting and/or supporting the bundled tube segments within the combustor would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supporting bundled tube segments within a combustor. The system includes an annular sleeve that extends circumferentially and axially within the combustor, a support lug that extends radially inward from the annular sleeve and an annular support frame that is disposed within the annular sleeve. The annular support frame includes an inner ring portion, an outer ring portion and a plurality of spokes that extend radially between the inner and outer ring portions. The inner ring portion, the outer ring portion and the plurality of spokes define an annular array of openings for receiving a respective bundled tube segment. The inner ring portion is connected to each bundled tube segment and the outer ring portion is coupled to the support lug.

Another embodiment of the present invention is a combustor. The combustor includes an end cover that is coupled to an outer casing. An annular sleeve extends circumferentially and axially within the combustor. The annular sleeve is rigidly fixed into position within the combustor. A first bundled tube segment and a second bundled tube segment are arranged annularly within the annular sleeve downstream from the end cover. A support lug extends radially inward from the annular sleeve. An annular support frame is disposed concentrically within the annular sleeve. The annular support frame includes an inner ring portion, an outer ring portion and a plurality of spokes that extend radially between the inner and outer ring portions. The inner ring portion, the outer ring portion and the plurality of spokes define a first opening for receiving the first bundled tube segment and a second opening for receiving the second bundled tube segment. The annular support frame is coupled to the first bundled tube segment, the second bundled tube segment and the support lug.

The present invention may also include a gas turbine. The gas turbine includes a compressor and a combustor disposed downstream from the compressor. The combustor includes an end cover that is coupled to an outer casing. The gas turbine further includes a turbine that is disposed downstream from the combustor. The combustor further comprises an annular sleeve that extends circumferentially and axially within the combustor. The annular sleeve is rigidly fixed into position. A first bundled tube segment and a second bundled tube segment are arranged annularly within the annular sleeve downstream from the end cover. A support lug extends radially inward from the annular sleeve. An annular support frame is disposed concentrically within the annular sleeve. The annular support frame includes an inner ring portion, an outer ring portion and a plurality of spokes that extend radially between the inner and outer ring portions. The inner ring portion, the outer ring portion and the plurality of spokes define a first opening for receiving the first bundled tube segment and a second opening for receiving the second bundled tube segment. The annular support frame is coupled to the first bundled tube segment, the second bundled tube segment and the support lug.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
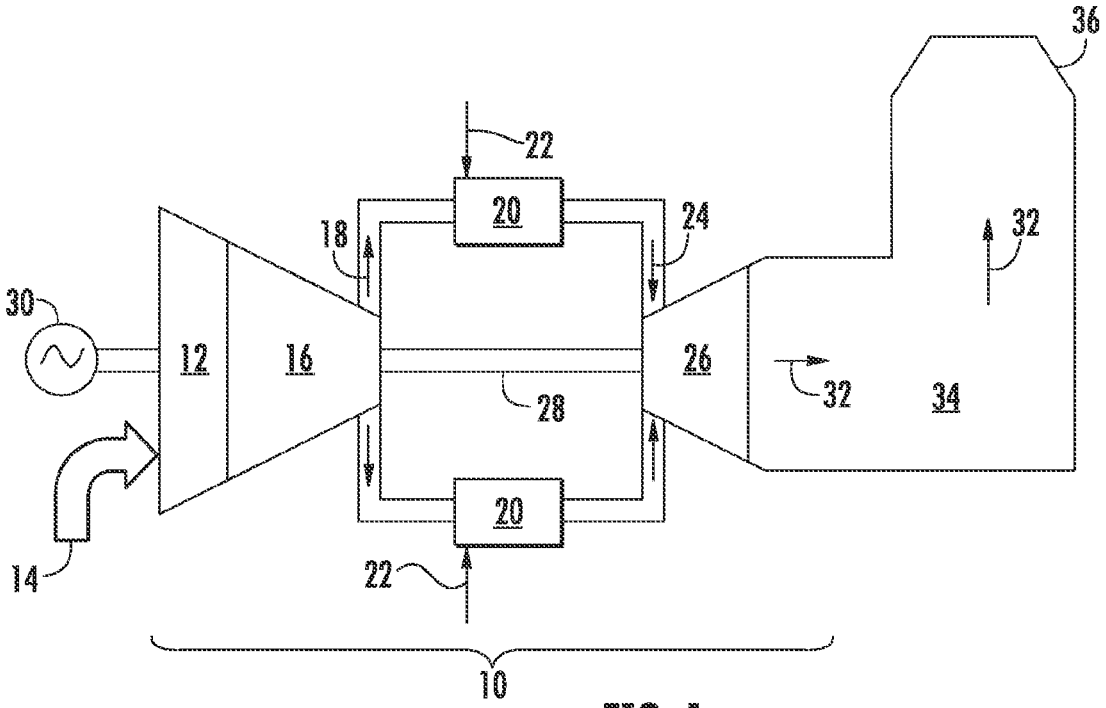
FIG. 1 provides a functional block diagram of an exemplary gas turbine 10 that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbo-machine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where a fuel 22 and the compressed working fluid 18 are mixed in each of the one or more combustors 20 to produce combustion gases 24 having a high temperature and pressure.

The combustion gases 24 flow through a turbine 26 where thermal and kinetic energy are transferred to one or more stages of turbine rotor blades (not shown) that are connected to a rotor shaft 28, thereby causing the rotor shaft 28 to rotate to produce work. For example, the rotor shaft 28 may be used to drive the compressor 16 to produce the compressed working fluid 18. Alternately or in addition, the rotor shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
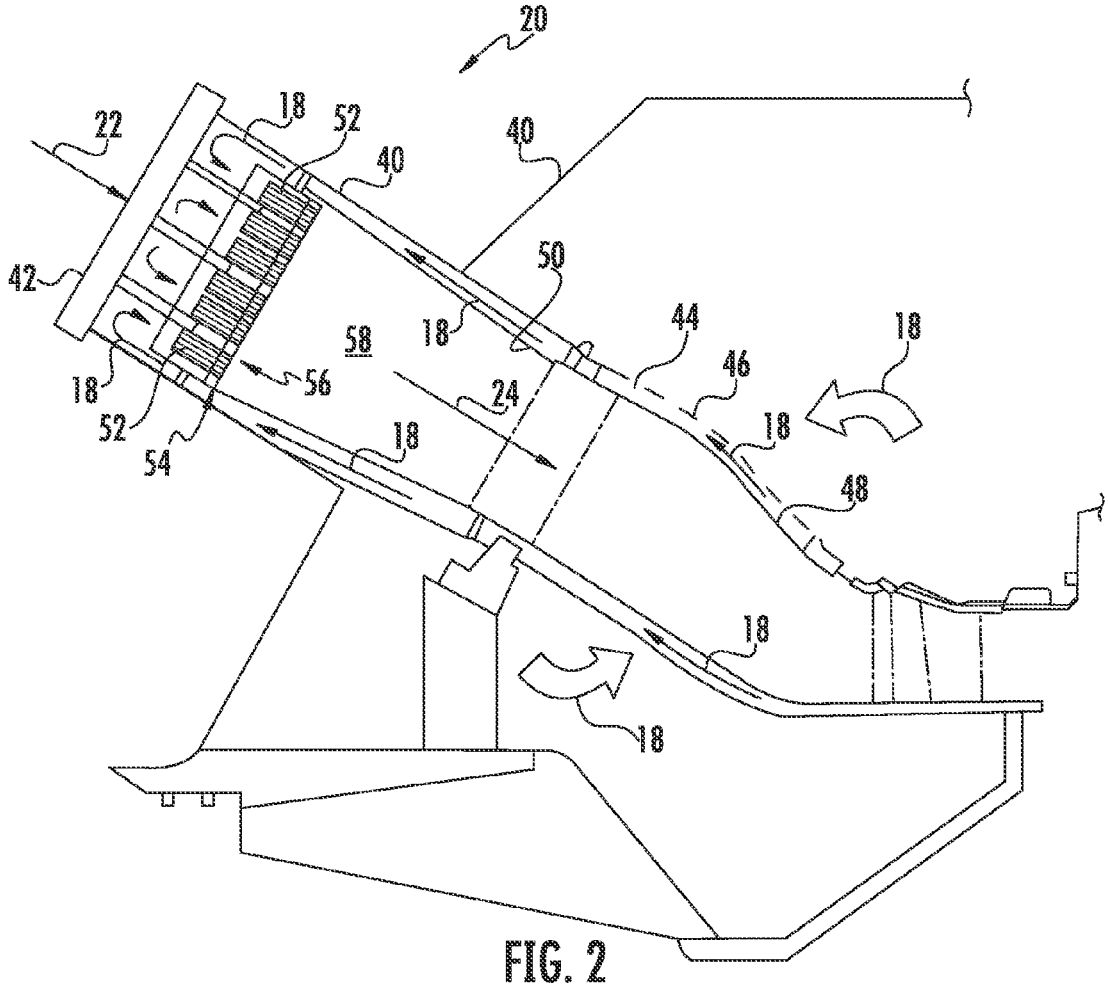
FIG. 2 provides a simplified side cross-section view of an exemplary combustor as may incorporate various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, an outer casing 40 and an end cover 42 disposed at one end of the combustor 20 may combine to contain the compressed working fluid 18 flowing to the combustor 20. The compressed working fluid 18 may pass through flow holes 44 in an impingement sleeve 46 to flow along the outside of a transition piece 48 and/or a liner 50 to provide convective cooling to the transition piece 48 and/or the liner 50.

The compressed working fluid 18 is routed to the end cover 42 where it reverses direction and flows through a plurality of bundled tube fuel injectors or bundled tube segments 52 that are disposed downstream from the end cover 42. In particular embodiments, a cap assembly 54 extends radially and circumferentially across the bundled tube segments 52 proximate to an aft or downstream end 56 of the bundled tube segments 52. Fuel 22 is provided to the bundled tube segments 52 where the fuel 22 and the compressed working fluid 18 are premixed or combined within the bundled tube segments 52 before being injected into a combustion chamber 58 that is defined downstream from the cap assembly 54 within the combustor 20. The mixture of fuel 22 and compressed working fluid 18 is burned in the combustion chamber 58 to generate the hot combustion gases 24.

Figure 3:
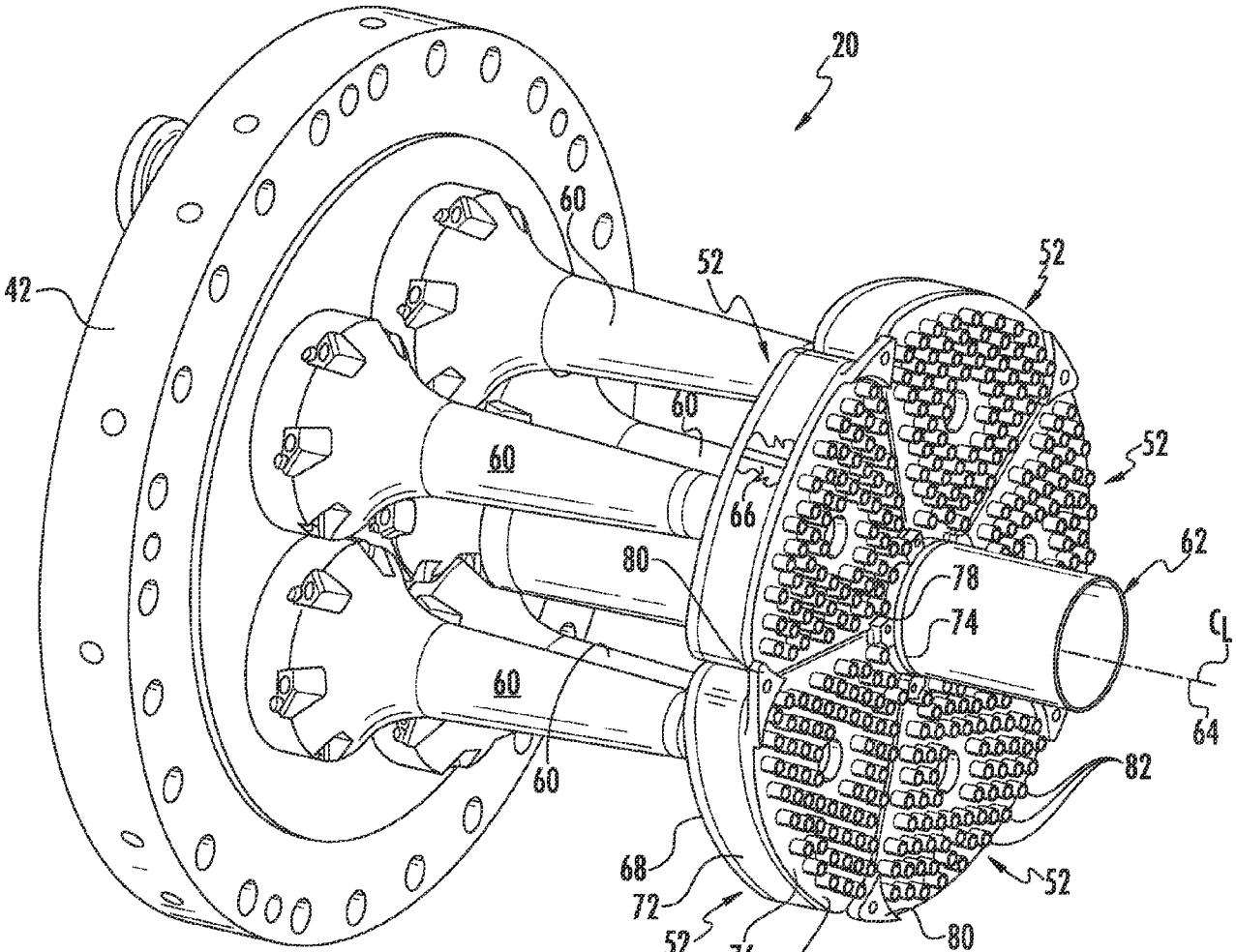
FIG. 3 provides a perspective view of a portion of the combustor as shown in FIG. 2 including an end cover and bundled tube segments, according to one embodiment of the present invention.

FIG. 3 provides a perspective view of a portion of the combustor 20 as shown in FIG. 2 including the end cover 42 and the bundled tube segments 52, according to one embodiment of the present invention. As shown in FIG. 3, a fluid conduit 60 provides for fluid communication between the end cover 42 and a corresponding bundled tube segment 52. As shown, the combustor 20 may include a plurality of the fluid conduits 60 that provide for fluid communication between the end cover 42 and the bundle tube segments 52. In particular embodiments, a center fuel nozzle 62 extends downstream from the end cover 42. The center fuel nozzle 62 may be substantially aligned with an axial centerline 64 of the end cover 42. The axial centerline 64 generally defines an axial direction within the combustor 20. In particular embodiments, as shown in FIG. 3 the bundled tube segments 52 are arcuate or wedge shaped and arranged in an annular array about the centerline 64 and/or about the center fuel nozzle 62 downstream from the end cover 42. Although five bundled tube segments 52 are illustrated in the various figures, it should be understood that the combustor 20 may comprise of any number of the bundled tube segments 52 and that the invention should therefore not be limited to five bundled tube segments 52.

Each bundled tube segment 52 generally comprises a fuel plenum 66 that is in fluid communication with the fluid conduit 60. In particular configurations, the fuel plenum 66 is generally defined within the bundled tube segment 52 between a first plate 68 and a second plate 70 that is axially separated from the first plate 68. The fuel plenum 66 may be further defined by an outer sleeve 72 that at least partially encases and/or that extends axially between the first plate 68 and the second plate 70. The second plate 70 generally includes an inner diameter portion 74 and an outer diameter portion 76. The outer diameter portion 76 is disposed radially outward from the inner diameter portion 74. An inner mounting feature 78 such as a boss or tab may be disposed along the inner diameter portion 74. An outer mounting feature 80 such as a boss or tab may be disposed along the outer diameter portion 76.

In various embodiments, each bundled tube segment 52 comprises a plurality of tubes 82 that extend axially through the fuel plenum 66. As shown, the tubes 82 may be substantially parallel to each other. Each or some of the tubes 82 may include one or more fuel ports (not shown) that provide for fluid communication between the fuel plenum 66 and the tubes 82. In this manner, fuel 22 may be injected into the tubes 82 from the fuel plenum 66 so as to provide the fuel 22 and compressed working fluid 18 mixture to the combustion chamber 58.

Although generally illustrated as cylindrical tubes in each embodiment, the cross-section of the tubes 82 may be any geometric shape, and the present invention is not limited to any particular cross-section unless specifically recited in the claims. The tubes 82 may be grouped in circular, triangular (as shown), square, or other geometric shapes and the tubes 82 may be arranged in various numbers and geometries.

Figure 4:
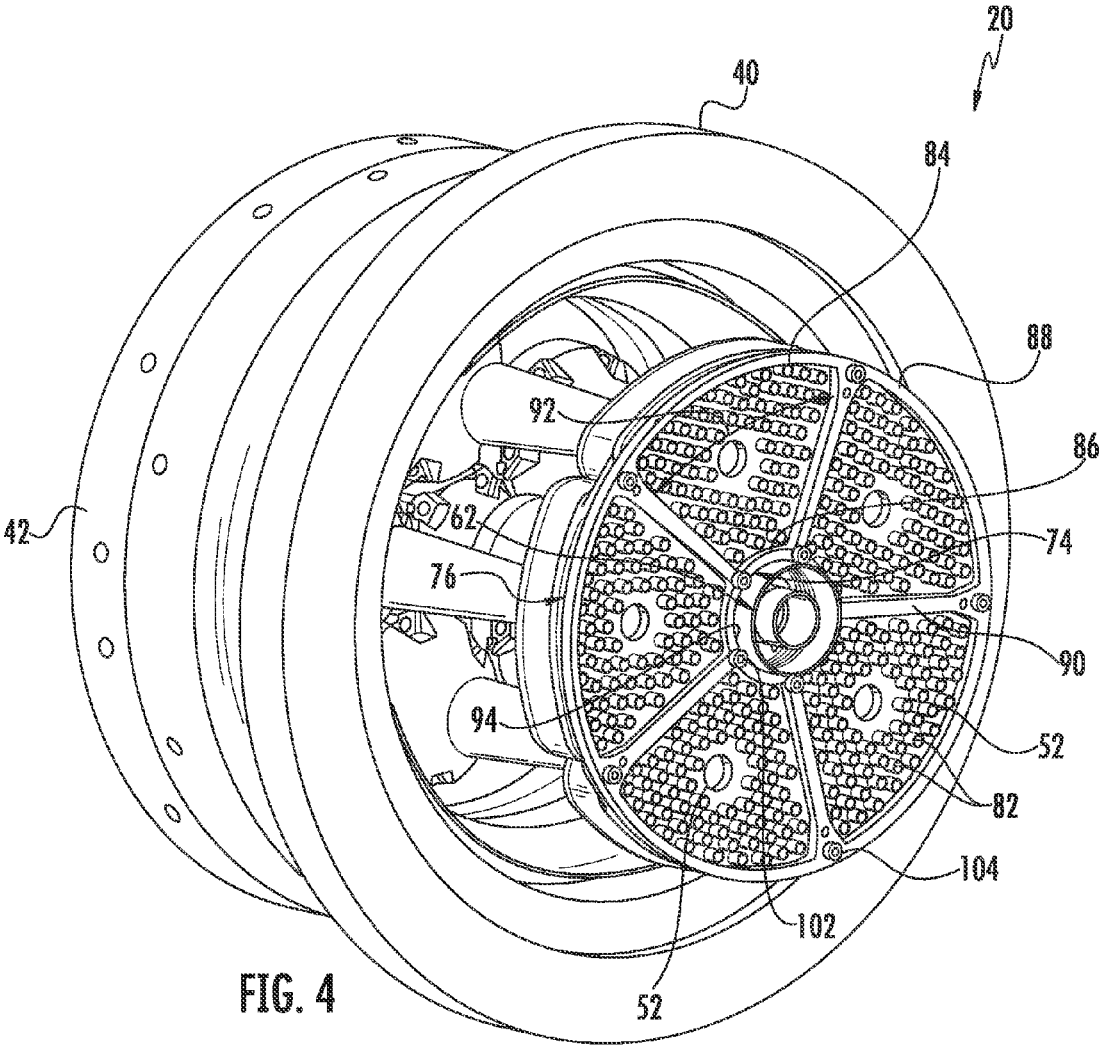
FIG. 4 provides a perspective view of a portion of the combustor as shown in FIG. 2, according to one embodiment of the present invention.
Figure 5:
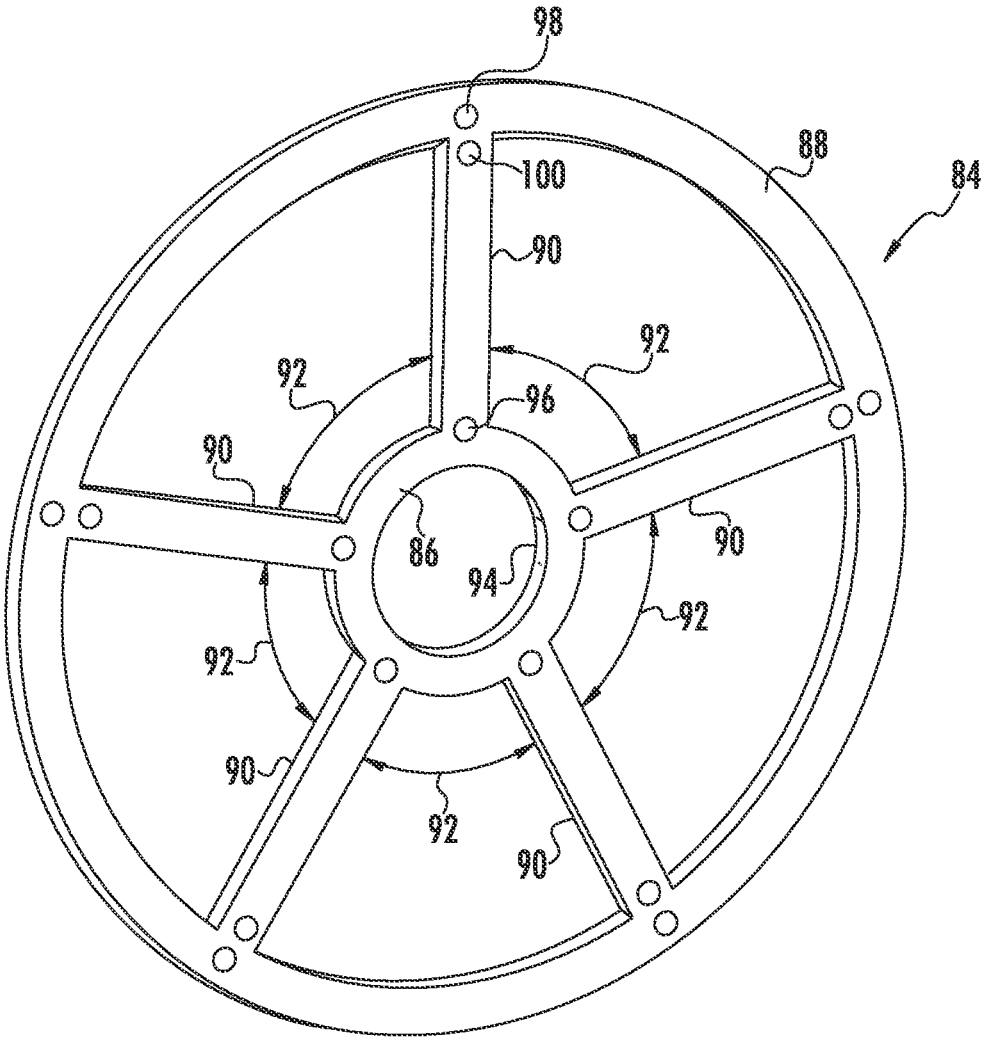
FIG. 5 provides a perspective view of an annular support frame as shown in FIG. 4, according to one or more embodiments of the present invention.

FIG. 4 provides a perspective view of a portion of the combustor 20 including the end cover 42, a portion of the outer casing 40 and the bundled tube segments 52 according to one embodiment of the present invention. In particular embodiments, an annular support frame 84 is disposed adjacent to the bundled tube segments 52. FIG. 5 provides a perspective view of the annular support frame 84 as shown in FIG. 4, according to one or more embodiments of the present invention. As shown in FIG. 5, the annular support frame 84 includes an inner ring portion 86, an outer ring portion 88 and a plurality of spokes 90 that extend radially between the inner and outer ring portions 86, 88. The inner ring portion 86, the outer ring portion 88 and the plurality of spokes 90 define a plurality of openings 92 therebetween. As shown in FIG. 4, the plurality of openings 92 are generally shaped and/or configured to receive the bundled tube segments 52. As shown, the tubes 82 extend at least partially through the openings 92. As shown in FIGS. 4 and 5, the inner support ring 86 may at least partially define a center fuel nozzle passage 94 for receiving the center fuel nozzle 62 (FIG. 4).

As shown in FIG. 5, the annular support frame 84 at least partially defines an inner mounting hole 96. The inner mounting hole 96 extends generally axially through the annular support frame 84 at or proximate to the inner ring portion 86. In addition or in the alternative, the annular support frame 84 may define an outer mounting hole 98. The outer mounting hole 98 extends generally axially through the annular support frame 84 at or proximate to the outer ring portion 88.

In particular embodiments, a support pin hole 100 is at least partially defined within the annular support frame 84. The support pin hole 100 extends at least partially through the annular support frame 84 at or proximate to the outer ring portion 88. The support pin hole 100 extends generally axially within the annular support frame 84. In particular embodiments, the annular support plate 84 may at least partially define a plurality of any one or each of the inner mounting hole 96, the outer mounting hole 98 or the support pin hole 100.

In particular embodiments, as shown in FIG. 4, the annular support ring 84 extends circumferentially around the outer diameter portion 76 and the inner diameter portion 74 of the bundled tube segments 52. Specifically, the outer ring portion 88 extends circumferentially around the outer diameter portion 76 and the inner ring portion 86 extends circumferentially around the inner diameter portion 74. The spokes 90 extend circumferentially and radially between adjacent bundled tube segments 52.

In particular embodiments, as shown in FIG. 4, a fastener 102 such as a bolt or the like extends through the inner mounting hole 96 to connect the inner ring portion 86 of the annular support frame 84 to the inner diameter portion 74 (FIG. 3) of a respective bundled tube segment 52. In addition or in the alternative, as shown in FIG. 4, a fastener 104 such as a bolt or the like extends through the outer mounting hole 98 to connect the outer ring portion 88 of the annular support frame 84 to the outer diameter portion 76 (FIG. 3) of a respective bundled tube segment 52. As shown in FIG. 4, a plurality of fasteners 102, 104 may be used to connect the inner and/or the outer ring portions 86, 88 of the annular support frame 84 to the bundled tube segments 52. The annular support frame generally ties the plurality of bundled tube segments 52 together to reduce relative movement between the adjacent bundled tube segments 52 caused by various factors such as mechanical vibrations and combustor dynamics.

Figure 6:
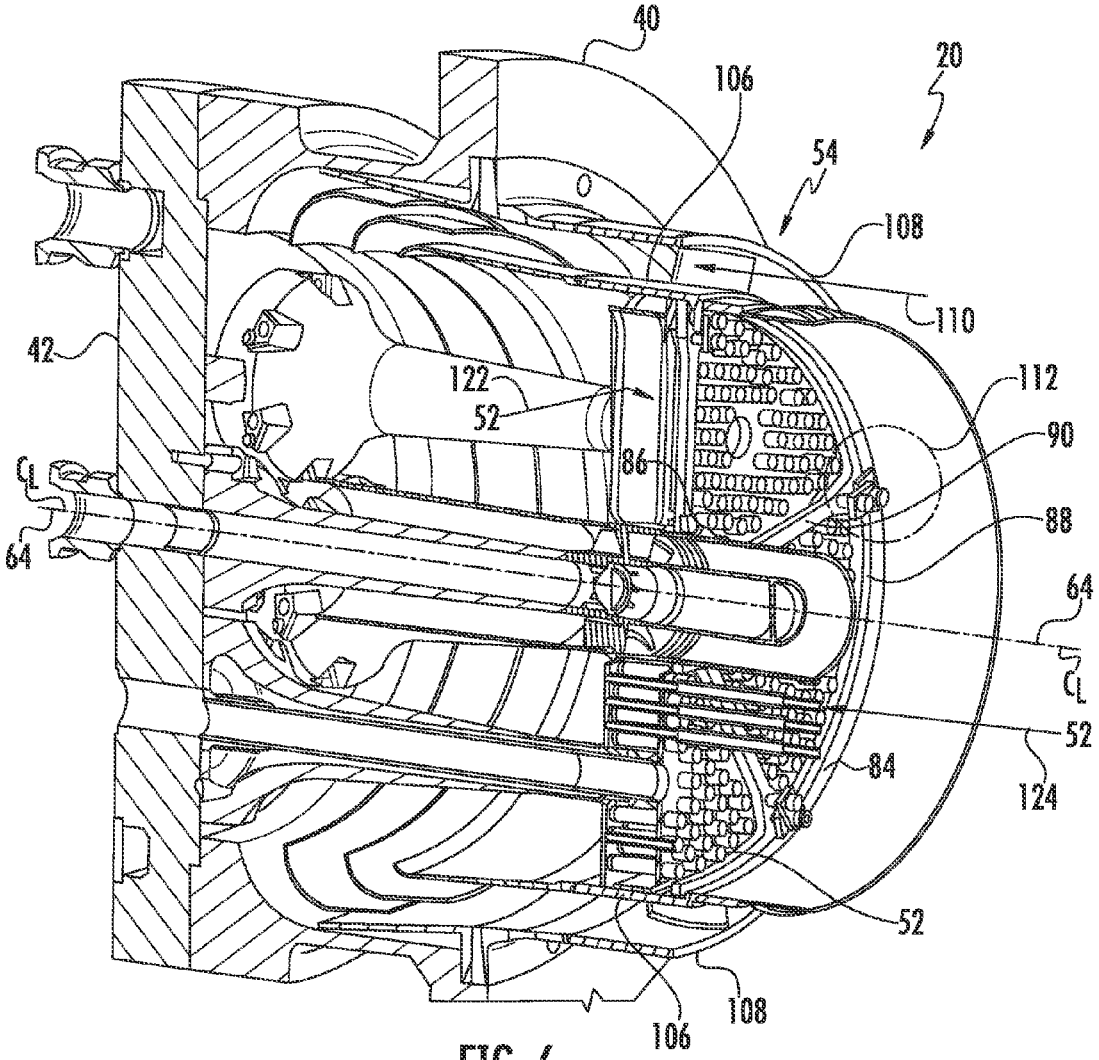
FIG. 6 provides a cross section perspective view of a portion of the combustor as shown in FIG. 4, according to one embodiment of the present disclosure.

FIG. 6 provides a cross section perspective view of a portion of the combustor 20 including a portion of the cap assembly 54 according to one embodiment of the present disclosure. As shown, the cap assembly 54 and/or the combustor 20 may include an annular sleeve 106 that extends circumferentially and axially within the combustor 20 with respect to centerline 64. The annular sleeve generally extends circumferentially around the bundled tube segments 52. In particular embodiments, the bundled tube segments 52 are arranged annularly within the annular sleeve 106. In one embodiment, the annular support frame 84 is disposed concentrically within the annular sleeve 106. In particular configurations, the annular sleeve 106 is rigidly fixed into position within the combustor 20. For example, in particular embodiments, the annular sleeve 106 may be coupled to an outer annular sleeve 108. The outer annular sleeve 108 may be radially separated from the annular sleeve 106 so as to define a flow path 110 therebetween. The outer annular sleeve 108 may be coupled to the outer casing 40 so as to rigidly fix the annular sleeve 106 into position within the combustor 20.

Figure 7:
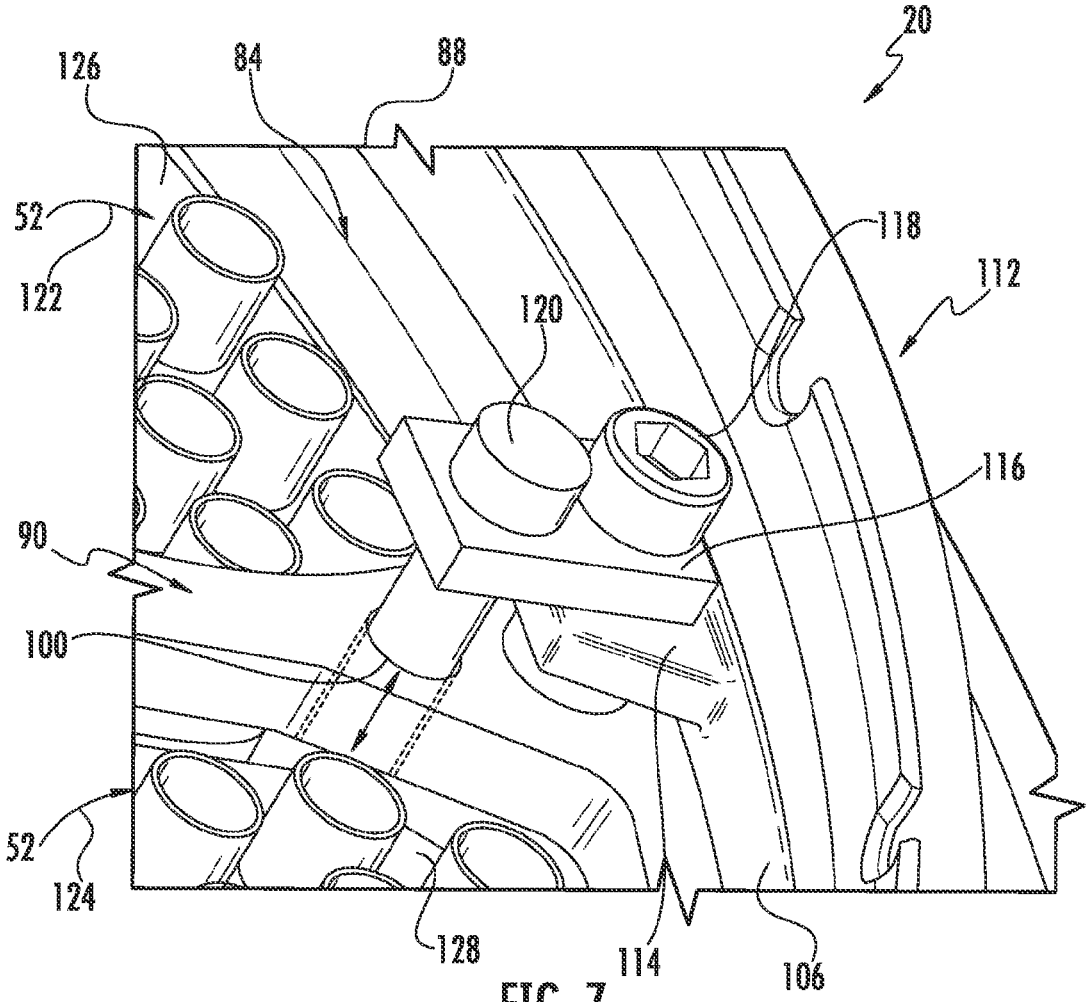
FIG. 7 provides an enlarged perspective view of a portion of the combustor as shown in FIG. 6, according to various embodiments of the present invention.

FIG. 7 provides an enlarged perspective view of a portion of the combustor as outlined within line 112 as shown in FIG. 6, according to various embodiments of the present invention. As shown in FIG. 7, a support lug 114 extends radially inward from the annular sleeve 106. In particular embodiments, the annular support frame 84 is coupled to the support lug 114 via a retention block 116. The retention block 116 may be coupled to the support lug by a fastener 118 such as a bolt or the like. In the alternative, the retention block 118 may be welded or brazed to the support lug 116 or in the alternative the retention block 118 may be coupled directly to the annular sleeve 106.

In one embodiment, as shown in FIG. 7, a support or guide pin 120 extends axially between the retention block 116 and the annular support plate 84. In one embodiment, the support pin 120 extends axially within the support pin hole 100 defined within the annular support frame 84, thus coupling the annular support frame 84 to the support lug 114 via the support pin 120. The support pin 120 is moveable in the axial direction with respect to centerline 64 (FIG. 6) within the support pin hole 100 (FIG. 7). This configuration prevents or reduces radial movement of the bundled tube segments 52 while allowing for axial translation due to thermal growth of the fluid conduits 60 and or the bundled tube segments 52 during operation of the combustor 20.

In one embodiment, as shown in FIGS. 6 and 7, the combustor 20 includes a first bundled tube segment 122 of the bundled tube segments 52 and a second bundled tube segment 124 of the bundled tube segments 52 arranged annularly within the annular sleeve 106 downstream from the end cover 42 (FIG. 6). The support lug 114 extends radially inward from the annular sleeve 106. The annular support frame 84 is disposed concentrically within the annular sleeve 106. The inner ring portion 86 (FIG. 6), the outer ring portion 88 (FIGS. 6 and 7) and the plurality of spokes 90 (FIGS. 6 and 7) define a first opening 126 (FIG. 7) for receiving the first bundled tube segment 122 and a second opening 128 (FIG. 7) for defining the second bundled tube segment 124. As shown in FIG. 6, the annular support frame 84 is coupled to the first bundled tube segment 122, the second bundled tube segment 124 and the support lug 114 (FIG. 7).

In further embodiments, the annular support frame 84 is coupled to the support lug 114 via the retention block 116 which is connected to the support lug 114. The support pin 120 extends axially between the retention block 116 and the annular support frame 84. The support pin 120 extends axially within the support hole and the support pin 120 is movable axially within the support hole 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for supporting bundled tube segments within a combustor, comprising:

a. an annular sleeve that extends circumferentially and axially within the combustor;

b. a support lug that extends radially inwardly from the annular sleeve;

c. an annular support frame disposed within the annular sleeve, the annular support frame having an inner ring portion, an outer ring portion and a plurality of spokes that extend radially between the inner and outer ring portions, wherein the annular support frame defines a plurality of outer mounting holes circumferentially spaced along the outer ring portion and a plurality of support pin holes defined radially inwardly from the plurality of outer mounting holes, each support pin hole being defined along a respective spoke, wherein the inner ring portion, the outer ring portion and the plurality of spokes define an annular array of openings for receiving circumferentially adjacent bundled tube segments; and d. wherein the inner ring portion is rigidly connected to each circumferentially adjacent bundled tube segment via a corresponding fastener and the outer ring portion is rigidly connected to the support lug via a plurality of fasteners, each fastener of the plurality of fasteners extending into a corresponding outer mounting hole of the plurality of mounting holes; and e. wherein the annular support frame is coupled to the support lug via a retention block that is connected to the support lug and via a support pin that extends axially between the retention block into a corresponding support pin hole of the plurality of support pin holes.

2. The system as in claim 1, wherein the annular sleeve is rigidly fixed in position within the combustor.

3. The system as in claim 1, wherein the outer ring portion is connected to the bundled tube segments.

4. The system as in claim 1, wherein the support pin is movable axially within the support pin hole.

5. A combustor, comprising:

f. an end cover coupled to an outer casing;

g. an annular sleeve that extends circumferentially and axially within the combustor, the annular sleeve being rigidly fixed into position;

h. a first bundled tube segment and a second bundled tube segment arranged annularly within the annular sleeve downstream from the end cover;

i. a support lug that extends radially inward from the annular sleeve;

j. an annular support frame disposed concentrically within the annular sleeve, the annular support frame having an inner ring portion, an outer ring portion and a plurality of spokes that extend radially between the inner and outer ring portions, wherein the inner ring portion, the outer ring portion and the plurality of spokes define a first opening for receiving the first bundled tube segment and a second opening for receiving the second bundled tube segment; and k. wherein the annular support frame is rigidly connected to a plate of the first bundled tube segment via a first fastener, rigidly connected to a plate of the second bundled tube segment via a second fastener and rigidly connected to the support lug via a retention block connected to the support lug and a third fastener.

6. The combustor as in claim 5, wherein at least one of the inner ring portion or the outer ring portion is connected to the first bundled tube segment and the second bundled tube segment.

7. The combustor as in claim 5, wherein the third fastener is a support pin that extends axially between the retention block and the annular support plate.

8. The combustor as in claim 7, further comprising a support pin hole defined within the annular support frame, wherein the support pin extends axially within the support pin hole.

9. The combustor as in claim 8, wherein the support pin is movable axially within the support pin hole.

10. The combustor as in claim 5, further comprising a support pin hole defined within the annular support frame, wherein the annular support frame is coupled to the support lug via a support pin that extends axially from the support lug and at least partially through the support pin hole.

11. The combustor as in claim 10, wherein the support pin is movable within the support pin hole.

12. A gas turbine, comprising:

a compressor;

a combustor disposed downstream from the compressor, the combustor having an end cover coupled to an outer casing;

a turbine disposed downstream from the combustor; and wherein the combustor comprises:

i. an annular sleeve that extends circumferentially and axially within the combustor, the annular sleeve being rigidly fixed into position;

ii. a first bundled tube segment circumferentially adjacent to second bundled tube segment, wherein the first and second bundled tube segments are arranged annularly within the annular sleeve downstream from the end cover;

iii. a support lug that extends radially inward from the annular sleeve;

iv. an annular support frame disposed concentrically within the annular sleeve, the annular support frame having an inner ring portion, an outer ring portion and a plurality of spokes that extend radially between the inner and outer ring portions, wherein the annular support frame defines a plurality of outer mounting holes circumferentially spaced along the outer ring portion and a plurality of support pin holes defined radially inwardly from the plurality of outer mounting holes, wherein the inner ring portion, the outer ring portion and the plurality of spokes define a first opening for receiving the first bundled tube segment and a second opening for receiving the second bundled tube segment; and v. wherein the annular support frame is rigidly connected to a plate of the first bundled tube segment, a plate of the second bundled tube segment and to the support lug via a retention block connected to the support lug and a support pin.

13. The gas turbine as in claim 12, wherein the support pin extends axially between the retention block and the annular support plate.

14. The gas turbine as in claim 13, further comprising a support pin hole defined within the annular support frame, wherein the support pin extends within the support pin hole and is movable axially within the support pin hole.

15. The gas turbine as in claim 12, further comprising a support pin hole defined within the annular support frame, wherein the annular support frame is coupled to the support lug via a support pin that extends axially from the support lug and at least partially through the support pin hole.

16. The gas turbine as in claim 15, wherein the support pin is movable axially within the support hole.

* * * * *